US006688805B1

(12) United States Patent
Kochling

(10) Patent No.: US 6,688,805 B1
(45) Date of Patent: Feb. 10, 2004

(54) PRE-CAST CURBSIDE ACCESS RAMP AND METHODS OF MAKING AND INSTALLING THE SAME

(76) Inventor: Edmund T. Kochling, 47 Hanson Rd., Charlton, MA (US) 01507

( * ) Notice: Subject to any disclaimer, the term of this patent is extended or adjusted under 35 U.S.C. 154(b) by 0 days.

(21) Appl. No.: 09/909,442

(22) Filed: Jul. 19, 2001

(51) Int. Cl.[7] ..... E01C 11/22; E01F 9/053

(52) U.S. Cl. ..... 404/7; 404/9; 404/10

(58) Field of Search ..... 404/7, 8, 9, 18, 404/34, 45, 1, 71; D34/32; 52/125.3, 586.1, 590.2, 591.1

(56) References Cited

U.S. PATENT DOCUMENTS 753,286 A * 3/1904 Morrison ..... 52/125.3
1,529,329 A * 3/1925 Turnbo ..... 404/7
3,842,562 A * 10/1974 Daigle ..... 404/50
4,445,802 A * 5/1984 Loov ..... 404/34
4,532,747 A * 8/1985 Koetje ..... 52/586.1
5,101,755 A * 4/1992 Barrett ..... 404/11
5,271,690 A * 12/1993 Fennessy, Sr. ..... 404/9
5,302,047 A * 4/1994 Ivey ..... 404/6
5,553,421 A 9/1996 Stratford

* cited by examiner

*Primary Examiner*—Michael Safavi
(74) *Attorney, Agent, or Firm*—Kriegsman & Kriegsman

(57) ABSTRACT

Pre-cast curbside access ramp and methods of making and installing the same. In a preferred embodiment, the pre-cast ramp is a quasi-trapezoidal member shaped to include an integrally formed curb portion, a trapezoidal central portion disposed behind the curb portion and a pair of generally triangular side portions disposed behind the curb portion and seamlessly transitioning from opposite sides of the central portion. The ramp is made using a forming apparatus comprising an inner form positioned within an outer form. The inner form, which is more shallow than the outer form, is filled with gravel. A steel grid is then positioned within the outer form and over the inner form. The outer form is then filled with concrete, which is then shaped, screeded, edged, grooved, troweled and allowed to harden within the outer form. When removed from the outer form, the bottom of the cast is provided with a weight-reducing recess. To install, a suitable length of curbing and walkway are removed, and the cast is set in the ground. Asphalt or concrete is then used to grade from the cast to the remainder of the walkway.

6 Claims, 13 Drawing Sheets

PRE-CAST CURBSIDE ACCESS RAMP AND METHODS OF MAKING AND INSTALLING THE SAME

BACKGROUND OF THE INVENTION

The present invention relates generally to curbside access ramps of the type used to interconnect walkways and roadways and relates more particularly to a novel curbside access ramp and to methods of making and installing the same.

Curbside access ramps used to interconnect walkways (i.e., sidewalks) and roadways in a manner that is wheelchair-accessible are becoming increasingly more prevalent throughout the U.S. and abroad. In fact, over the last several years, the availability of curbside access ramps at specific locations, such as at certain roadway intersections, has been mandated by various federal, state and local rules and regulations. Typically, such rules and regulations specify that the curbside access ramp must have a longitudinal slope from the roadway to the walkway that does not exceed a predetermined maximum value (typically 1:12). In addition, such rules and regulations typically specify that the ramp must include a pair of flared sides each having a transverse slope that does not exceed a predetermined maximum value (typically 1:10). Compliance with the aforementioned slope requirements is often difficult to achieve, however, since the ramp is typically constructed after the roadway and the walkway have already been constructed, with the distance between the roadway and the walkway and the respective heights of the roadway and the walkway already having been set.

In addition to the aforementioned problem of compliance with governmental rules and regulations, curbside access ramps are currently formed in a manner that is both time and labor intensive, not to mention lacking uniformity in construction techniques. Nevertheless, the installation of a conventional curbside access ramp often involves the following types of steps: cutting into three sections that portion of the curb located where the ramp is to be built; removing the curb sections; digging a hole from the roadway to the walkway where the ramp is to be built and spreading a layer of gravel in the thus-created ramp hole; laying the middle section of the cut curb flush with the roadway so as to bound a portion of the ramp hole; sloping the side sections of the cut curb to transition from the middle section of the cut to the remainder of the curb; laying the side sections of the cut curb in the ground on opposite ends of the middle section so as to bound additional portions of the ramp hole; positioning a form within the ramp hole and, if desired, grading the ramp hole with gravel or the like; pouring concrete into the form; and shaping, screeding, edging, grooving, and troweling the poured concrete to its finished form.

Once the above-described concrete ramp has been formed, the ramp then must be allowed to harden over a period of several days. In general, the ramp will harden to about 95% strength in about 7 days and will harden to about 100% strength in about 28 days. As can readily be appreciated, one of the challenges encountered in making such ramps is to keep pedestrians, motorists and the like off of the ramp until the ramp has sufficiently hardened. This often requires the hiring of a person to guard the ramp against trespassers, thereby further adding to the cost of making the ramp.

In addition, as can readily be appreciated, the occurrence of adverse weather conditions may complicate or preclude the construction of the above-described ramp and may elongate the period of time required for the ramp to harden.

SUMMARY OF THE INVENTION

It is an object of the present invention to provide a novel curbside access ramp.

It is another object of the present invention to provide a curbside access ramp as described above that overcomes at least some of the problems described herein that are associated with existing curbside access ramps.

In furtherance of the above objects, as well as other objects hereinafter to be described, the present invention is directed, in one aspect, to a pre-cast curbside access ramp. Said pre-cast curbside access ramp is amenable to being manufactured, for example, in a factory setting or the like and then, once constructed, to being transported to a ramp site for installation. As a result, one advantage of said pre-cast curbside access ramp is that it may be mass-produced under uniform manufacturing conditions, including being allowed to completely harden before it is delivered to an installation site. Other advantages are described or are apparent from the discussion below.

One feature of the aforementioned pre-cast curbside access ramp is the provision therein of an integrally formed curb portion. Another feature of the aforementioned pre-cast curbside access ramp is the use of steel-reinforced concrete in its construction. Still another feature of the aforementioned pre-cast curbside access ramp is the provision of a recessed area in its bottom that reduces the weight of the pre-cast ramp by approximately 500 lbs.

According to a preferred embodiment, the pre-cast curbside access ramp is a quasi-trapezoidal member having a top, a bottom, a front, a rear, a front left side, a rear left side, a front right side and a rear right side. An integrally formed curb portion extends from said front left side to said front right side of the ramp. Said integrally formed curb portion includes a central region adapted to lie flush with a roadway and side regions disposed on opposite ends of said central region adapted to slope gradually upwardly from said central region. Said ramp is further shaped to include a central region and a pair of side regions, said central region and said side regions being disposed behind said integrally formed curb portion, said side regions being disposed on opposite sides of said central region and transitioning seamlessly therefrom, said central region sloping from said integrally formed curb portion to said rear with a maximum slope of no greater than 1:12, said side regions sloping from said central region to said rear left side and said rear right side, respectively, with a maximum slope of no greater than 1:10.

Preferably, a pair of brightly-colored, textured markers are mounted on opposite ends of said By central region of said integrally formed curb portion for the purpose of indicating the location of said central region of said integrally formed curb portion. In addition, a textured, recessed plate is preferably secured to the top of said pre-cast curbside access ramp and centrally located within the central region of said pre-cast curbside access ramp proximate to said rear for the purpose of indicating the location of the central portion of the integrally formed curb portion. Said textured, recessed plate may be, for example, an aluminum diamond plate or may be a bronze medallion embossed with advertising.

The aforementioned markers and recessed plate may also be retrofitted to existing curbside access ramps for use in identifying the points of entry therefor.

The present invention is also directed to a method of making a pre-cast curbside access ramp, said method comprising the steps of (a) positioning a forming apparatus on a horizontal surface, said forming apparatus comprising an inner form and an outer form, said outer form being shaped to define generally the outer dimensions of a desired pre-cast curbside access ramp, said inner form being positioned within said outer form and being more shallow than said outer form; (b) sealing the top of said inner form to prevent concrete from being poured thereinto; (c) then, filling said outer form with concrete; (d) then, finishing the concrete within said outer form; (e) then, allowing the finished concrete to harden within the finished form; (f) then, removing the hardened concrete from the forming apparatus.

Preferably, said sealing step comprises filling said inner form with gravel, and said finishing step comprises forming an appropriately placed groove in the concrete to delineate an integrally formed curb portion. In addition, said removing step preferably comprises lifting the hardened concrete away from the gravel and separating the hardened concrete from the inner and outer forms. Furthermore, said method further comprises, after said sealing step and before said filling step, the step of positioning a reinforcing steel grid within said outer form and over said inner form.

The present invention is also directed to a method of bridging a walkway and a roadway, said walkway and said roadway being situated at different elevations, said method comprising the steps of (a) forming a pre-cast curbside access ramp; (b) forming a ramp hole sized to receive the pre-cast curbside access ramp, said ramp hole extending from the rear of the roadway to the front of the walkway and also including a portion of the adjacent walkway at least as long as the pre-cast curbside access ramp; (c) installing the pre-cast curbside access ramp in the ramp hole; and (d) then, constructing a platform in the remainder of the ramp hole extending from the installed pre-cast curbside access ramp to the remainder of the walkway.

Preferably, the aforementioned platform is made of asphalt or, more preferably, concrete.

Additional objects, features, aspects and advantages of the present invention will be set forth, in part, in the description which follows and, in part, will be obvious from the description or may be learned by practice of the invention. In the description, reference is made to the accompanying drawings which form a part thereof and in which is shown by way of illustration specific embodiments for practicing the invention. These embodiments will be described in sufficient detail to enable those skilled in the art to practice the invention, and it is to be understood that other embodiments may be utilized and that structural changes may be made without departing from the scope of the invention. The following detailed description is, therefore, not to be taken in a limiting sense, and the scope of the present invention is best defined by the appended claims.

BRIEF DESCRIPTION OF THE DRAWINGS

The accompanying drawings, which are hereby incorporated into and constitute a part of this specification, illustrate preferred embodiments of the invention and, together with the description, serve to explain the principles of the invention. In the drawings wherein like reference numerals represent like parts.

DETAILED DESCRIPTION OF PREFERRED EMBODIMENTS

Figure 1:
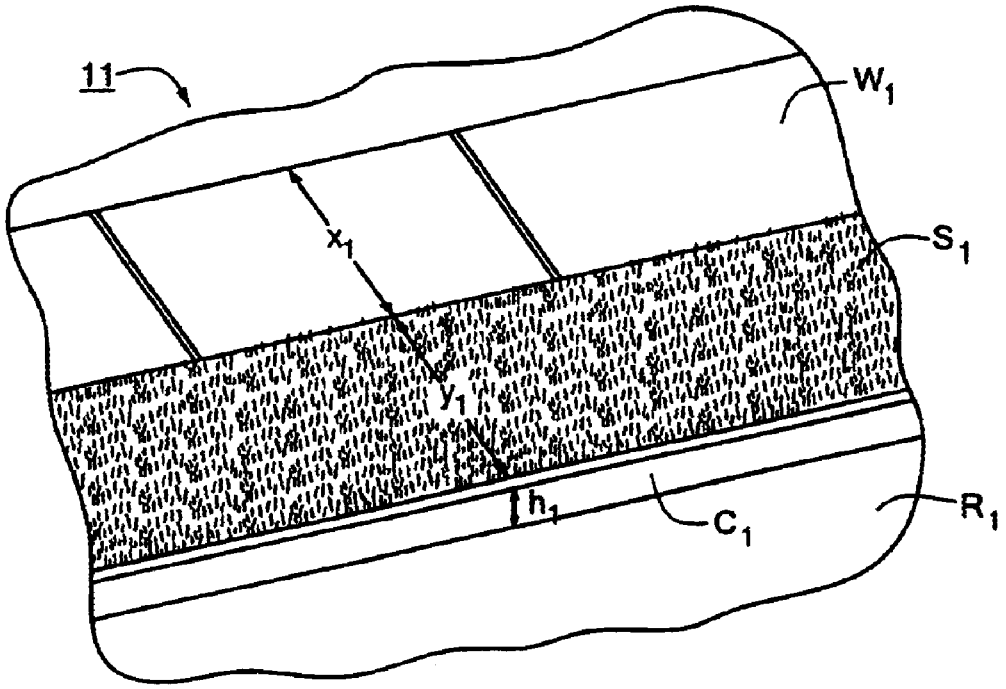
FIG. 1 is a perspective view of a first area through which a walkway and a roadway pass in the same generally direction at different elevations, said first area lacking a ramp for interconnecting said walkway and said roadway.

Referring now to FIG. 1, there is shown a perspective view of an area through which a walkway $W_1$ and a roadway $R_1$ extend in the same general direction at different elevations, said area being represented generally by reference numeral 11. Walkway $W_1$ and roadway $R_1$ are separated from one another within area 11 by a grassy strip $S_1$ and a granite curb $C_1$. Walkway $W_1$ has a width $x_1$ of approximately 4 feet, strip $S_1$ has a width $y_1$ of approximately 6 feet, and curb $C_1$ has a height $h_1$ of approximately 6 inches. As can readily be seen, area 11 does not include a wheelchair-accessible ramp for interconnecting walkway $W_1$ and roadway $R_1$.

Figure 2A:
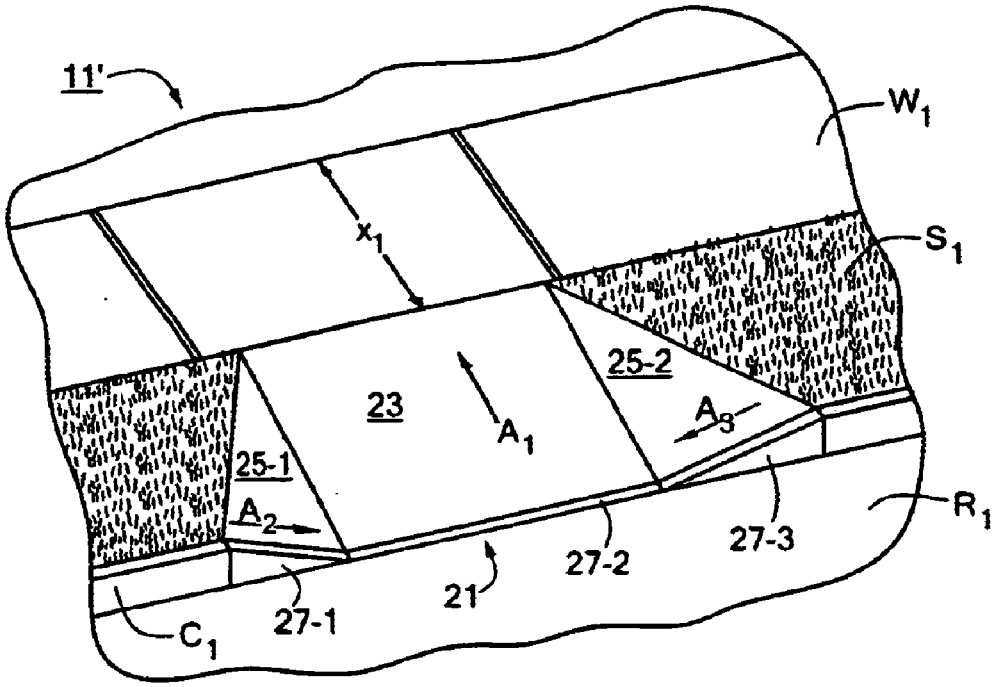
FIGS. 2(*a*) through 2(*c*) are perspective, top and front views, respectively, of the area of FIG. 1 following the installation of a first conventional curbside access ramp thereinto.
Figure 2B:
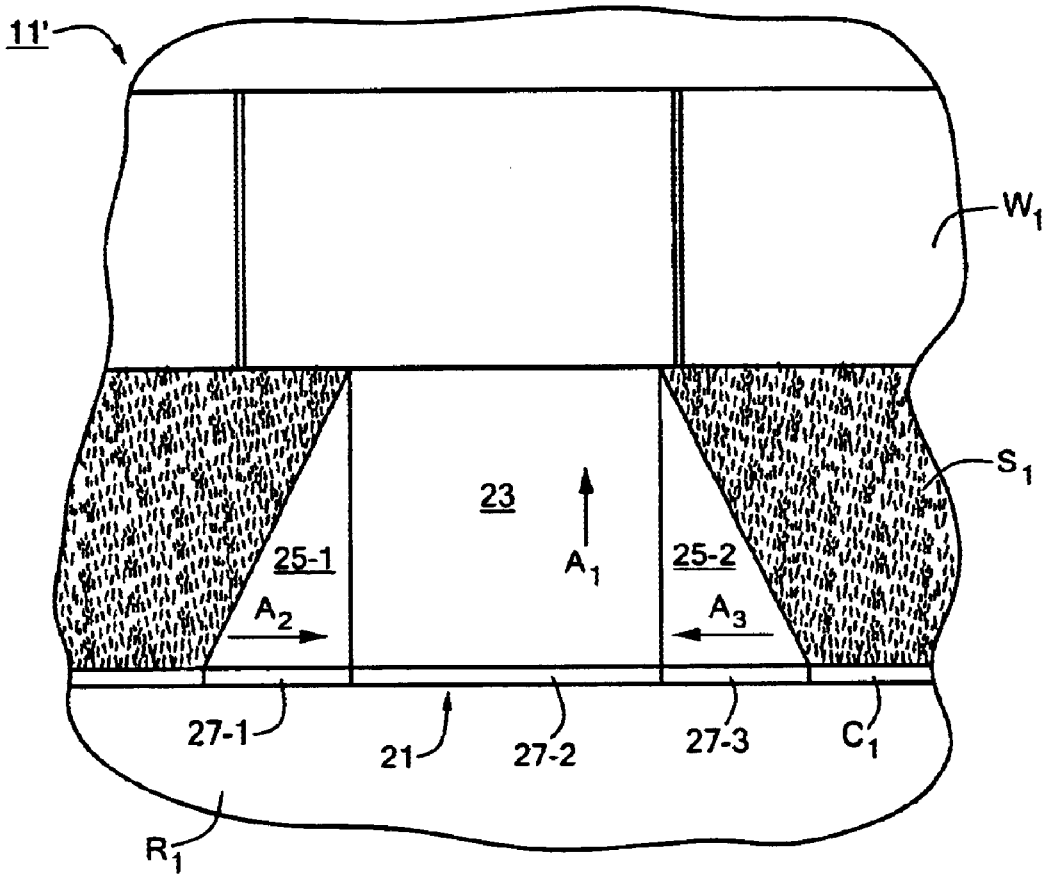
Figure 2C:
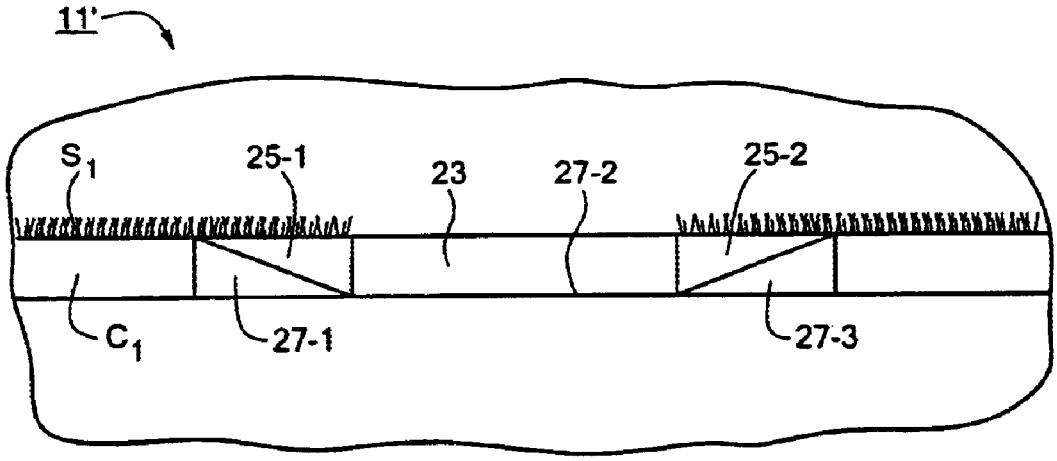

Referring now to FIGS. 2(*a*) through 2(*c*), there are shown perspective, top and front views, respectively, of the area of FIG. 1 following the installation of a first conventional curbside access ramp thereinto, said first conventional curbside access ramp being represented generally by reference numeral 21, the thus-modified area including ramp 21 being represented generally by reference numeral 11'.

Ramp 21, which extends from the front edge of walkway $W_1$ to the rear edge of roadway $R_1$, comprises a generally rectangular, middle section 23 and a pair of generally triangular, mirror-image (i.e., flared), side sections 25-1 and 25-2. The slope of middle section 23, as measured in the direction indicated by arrow $A_1$ from roadway $R_1$ to walkway $W_1$, is approximately 1:12, given that the height of curb $C_1$ is approximately 6 inches and that the distance between roadway $R_1$ and walkway $W_1$ is approximately 6 feet. The slope of each of side sections 25-1 and 25-2, as measured transversely relative to the aforementioned slope of middle section 23 and as indicated by arrows $A_2$ and $A_3$, respectively, is approximately 1:10.

Ramp 21 further comprises a plurality of curb sections 27-1 through 27-3, which are positioned between roadway $R_1$ and sections 25-1, 23 and 25-2, respectively. Curb section 27-2 is set in the ground so as to lie flush with the rear edge of roadway $R_1$ and the front edge of middle section 23. Curb sections 27-1 and 27-3 are set in the ground on opposite ends of section 27-2 and in front of sections 25-1 and 25-2, respectively, and are sloped to smoothly transition the top surface of curb section 27-2 to the top surface of the remainder of curb $C_1$.

Ramp 21 is typically made in the conventional manner described above. More specifically, ramp 21 is typically made by transversely cutting curb $C_1$ into the three sections that are to become sections 27-1 through 27-3; removing said three curb sections; digging a hole in strip $S_1$ where sections 25-1 through 25-3 are to be formed; spreading a layer of gravel in the thus-created ramp hole; cutting down the thickness of the middle cut curb section to form curb section 27-2 and setting curb section 27-2 in the ground so that it lies flush with the rear edge of roadway $R_1$ and bounds a portion of the front edge of the ramp hole; setting the remaining two sections of the cut curb in the ground on opposite ends of section 27-2 to bound the remainder of the front edge of the ramp hole and sloping said two sections (to yield sections 27-1 and 27-3) so that a smooth transition is formed between the top surface of section 27-2 and the top surface of the remainder of curb $C_1$; positioning a form within the ramp hole to bound the rear and side edges of the yet-to-be-formed ramp; grading the ramp hole with gravel or the like; pouring concrete into the form; shaping, screeding, edging, grooving, and troweling the poured concrete to define sections 25-1 through 25-3; and allowing sections 25-1 through 25-3 to harden.

As can readily be appreciated, the manufacture of ramp 21 according to the above method is time and labor intensive. Nevertheless, ramp 21 is sized and shaped to comply with existing federal and Massachusetts regulations.

Figure 3:
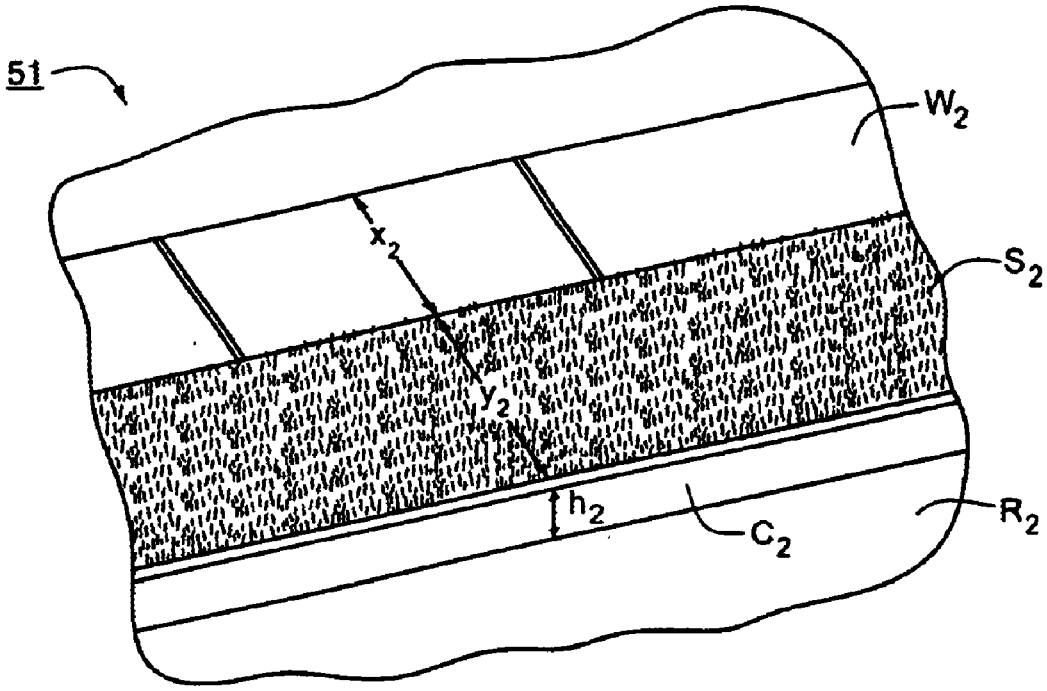
FIG. 3 is a perspective view of a second area through which a walkway and a roadway pass in the same general direction at different elevations, said second area lacking a ramp for interconnecting said walkway and said roadway.

Referring now to FIG. 3, there is shown a perspective view of an area through which a walkway $W_2$ and a roadway $R_2$ extend in the same general direction at different elevations, said area being represented generally by reference numeral 51. Walkway $W_2$ and roadway $R_2$ are separated from one another within area 51 by a grassy strip $S_2$ and a granite curb $C_2$. Walkway $W_2$ has a width $x_2$ of approximately 3.5 feet, strip $S_2$ has a width $Y_2$ of approximately 4 feet, and curb $C_2$ has a height $h_2$ of approximately 8 inches. As can readily be seen, area 51 does not include a wheelchair-accessible ramp for interconnecting walkway $W_2$ and roadway $R_2$.

Figure 4:
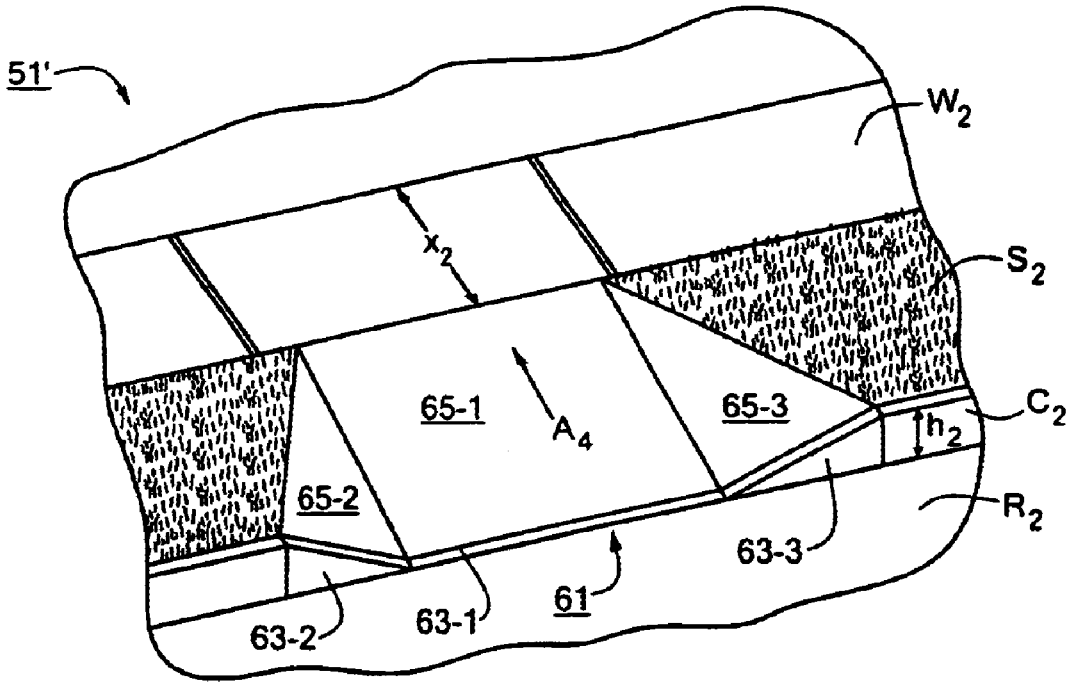
FIG. 4 is a perspective view of the area of FIG. 3 following the installation of a second conventional curbside access ramp thereinto.
Figure 5A:
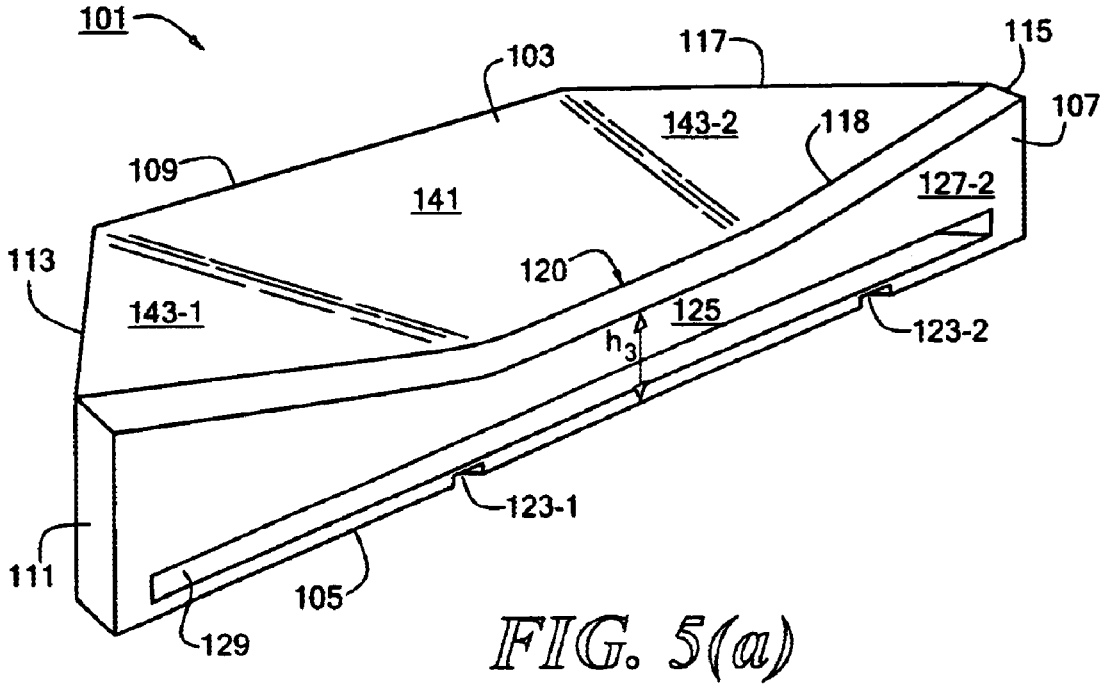
FIGS. 5(*a*) through 5(*g*) are perspective, top, bottom, front, back, left side and right side views, respectively, of a first embodiment of a pre-cast curbside access ramp constructed according to the teachings of the present invention.
Figure 5B:
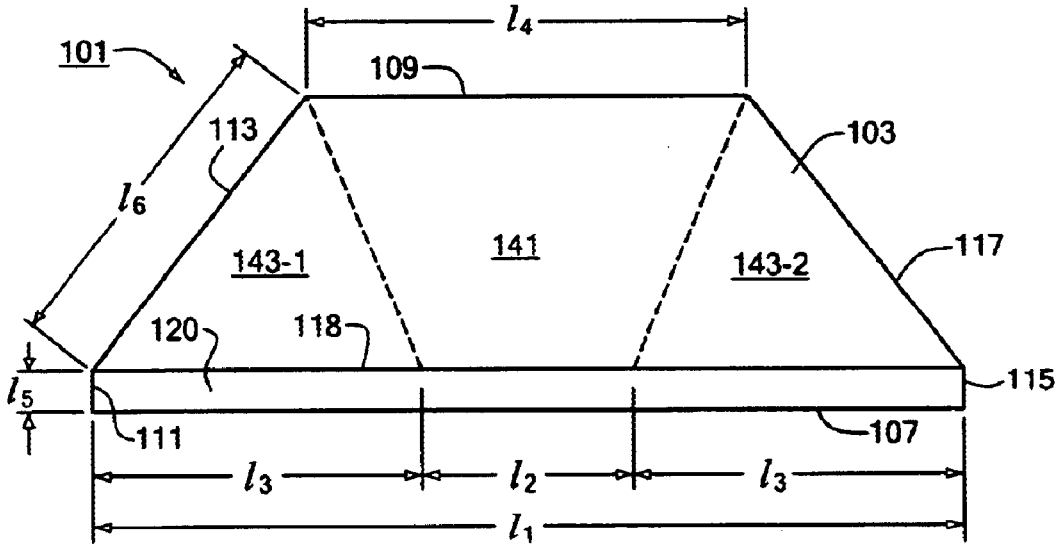
Figure 5C:
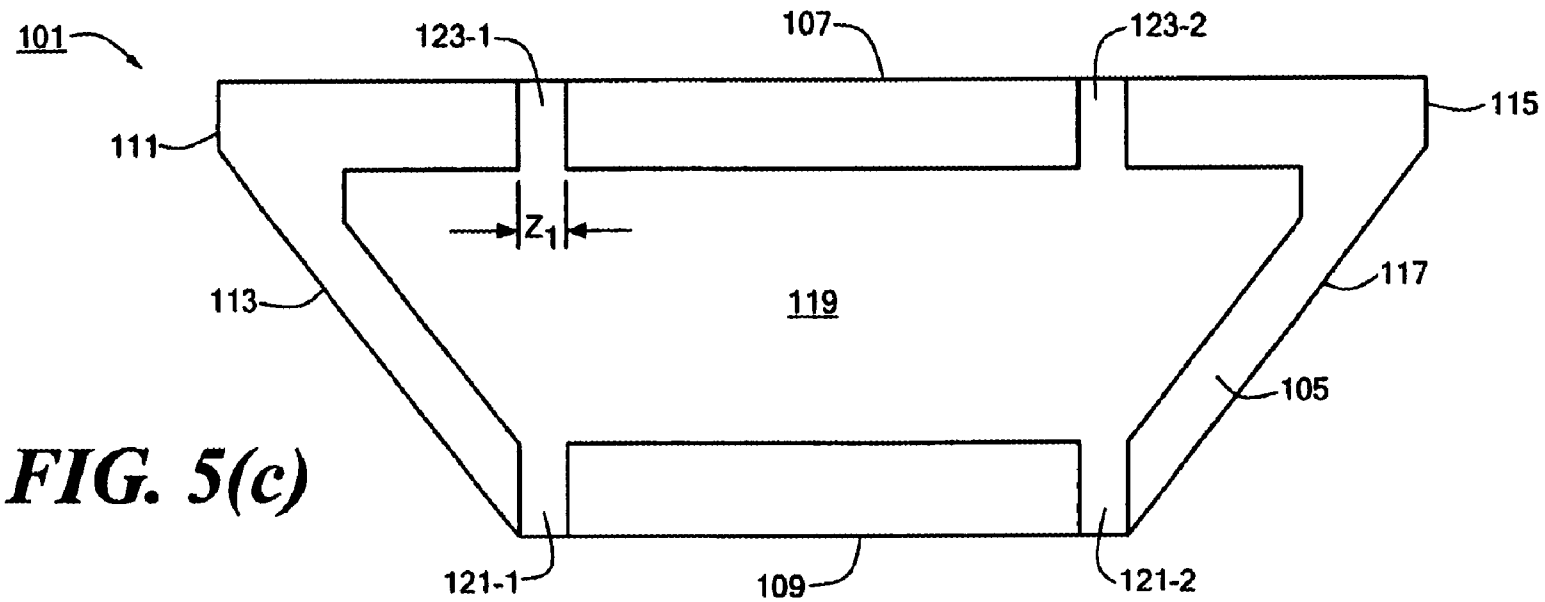
Figure 5D:
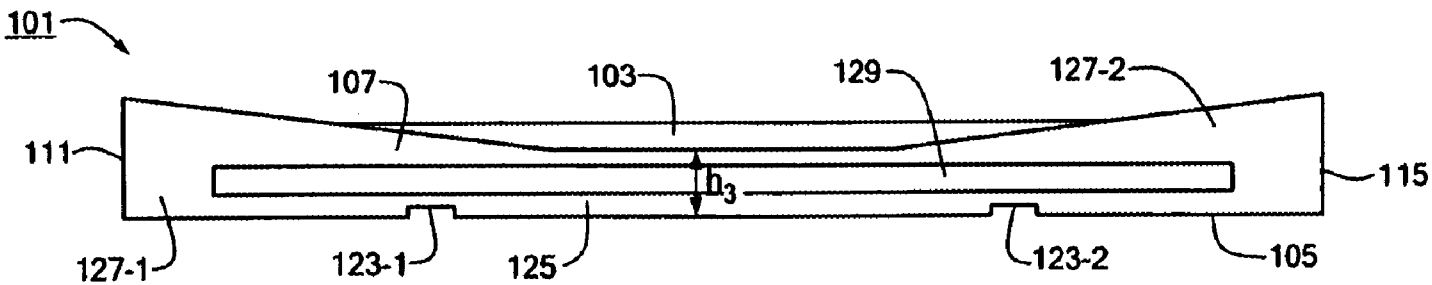
Figure 5E:
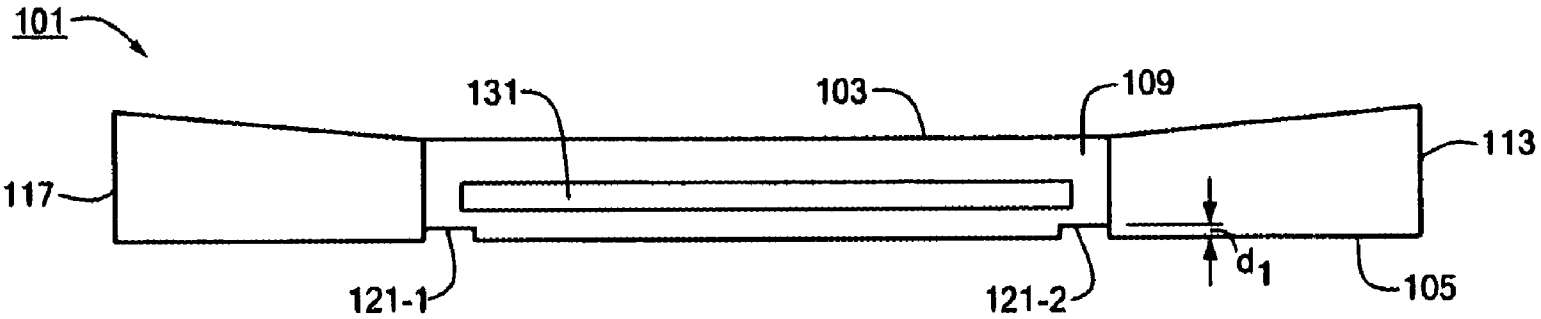
Figure 5G:
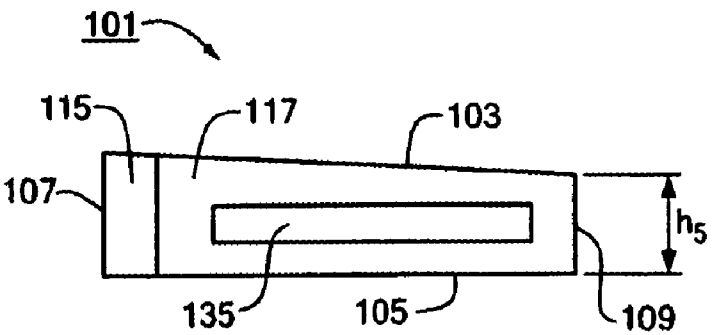
Figure 5F:
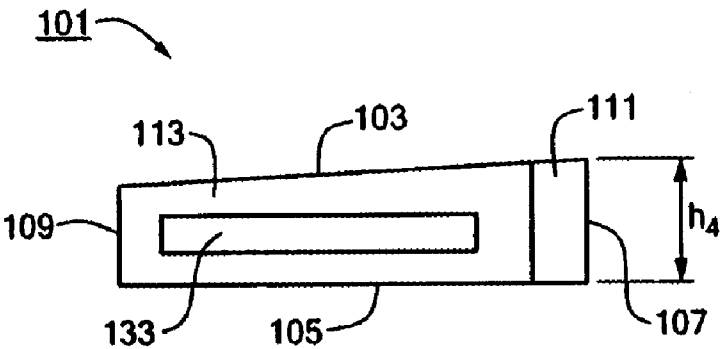

Referring now to FIG. 4, there is shown a perspective view of the area of FIG. 3 following the installation of a second conventional curbside access ramp thereinto, said second conventional curbside access ramp being represented generally by reference numeral 61, the thus-modified area including ramp 61 being represented generally by reference numeral 51'.

Ramp 61 is similar in many respects to ramp 21, ramp 61 comprising a middle curb section 63-1 and a pair of side curb sections 63-2 and 63-3. Middle curb section 63-1 is set in the ground so as to be flush with roadway $R_2$. Side curb sections 63-2 and 63-3 are set in the ground on opposite ends of curb section 63-1 and are sloped to transition from middle curb section 63-1 to the remainder of curb $C_2$.

Ramp 61 also comprises a generally rectangular, middle concrete section 65-1 and a pair of flared, side concrete sections 65-2 and 65-3. Middle concrete section 65-1 extends from middle curb section 63-1 to walkway $W_2$, and side concrete sections 65-2 and 65-3 extend from side curb sections 63-2 and 63-3, respectively, to walkway $W_2$.

Ramp 61 is made in a manner substantially identical to that used to make ramp 21. However, because curb $C_2$ has a height $h_2$ of approximately 8 inches (as compared to a height $h_1$ of approximately 6 inches for curb $C_1$) and strip $S_2$ has a width of approximately 4 feet (as compared to a height of approximately 6 feet for strip $S_1$), middle section 65-1 has a slope in the direction indicated by arrow $A_4$ of 1:6. Such a slope is too steep for compliance with federal and Massachusetts state regulations.

Consequently, as can be seen from the above, the existing method for producing curbside access ramps cannot be used to make fully compliant ramps unless the pre-existing spacing between the walkway and the roadway and the pre-existing curb height are such that, among other things, a maximum slope of 1:12 can be achieved. As a result, existing curbside access ramps lack uniformity in size and shape, with many such ramps failing to meet established standards. Moreover, as can readily be appreciated, even if the desired slopes can be achieved in the ramp, the existing method for producing the ramp is cumbersome.

Referring now to FIGS. 5(*a*) through 5(*g*), there are shown various views of a first embodiment of a pre-cast curbside access ramp constructed according to the teachings of the present invention, said pre-cast curbside access ramp being represented generally by reference numeral 101.

Ramp 101, which is made in the manner to be described below, comprises a quasi-trapezoidal, reinforced concrete member shaped to include a top 103, a bottom 105, a front 107, a rear 109, a front left side 111, a rear left side 113, a front right side 115 and a rear right side 117.

Top 103, which is curved in the manner to be described below, is provided with a joint or groove 118 extending from the rear of front left side 111 to the rear of front right side 115, groove 118 defining an integrally formed curb portion 120. Curb portion 120 may be colored (e.g., its outer surface painted or its entirety pigmented) and/or textured differently than the remainder of ramp 101 to facilitate its identification by sight-impaired individuals, seeing-eye dogs and the like. As can readily be appreciated, one advantage to having ramp 101 include integrally-formed curb portion 120 is that there is no need to cut and slope the three curb sections in the manner that is required to be done conventionally.

Bottom 105 is provided with a recessed portion or cavity 119, cavity 119 being similar in overall shape to ramp 101 and being concentrically-disposed within bottom 105. As will hereinafter be described, cavity 119 serves to reduce the overall weight of ramp 101 so that it can be transported more easily from its place of manufacture to its place of use. Bottom 105 is also provided with a first pair of parallel slots 121-1 and 121-2 that extend from cavity 119 to rear 109 and a second pair of parallel slots 123-1 and 123-2 that extend from cavity 119 to front 107, slots 121-1 and 123-1 being collinear and slots 121-2 and 123-2 being collinear. Slots 121-1, 121-2, 123-1 and 123-2 are dimensioned to receive a pair of straps that may be looped around ramp 101 so that ramp 101 may be lifted and/or transported by said straps using the boom of a backhoe or the like.

Front 107, which has a level bottom edge, is shaped to include a central region 125 and a pair of side regions 127-1 and 127-2, side regions 127-1 and 127-2 transitioning seamlessly from central region 125. Central region 125 is generally rectangular in shape and has a constant height $h_3$. Side regions 127-1 and 127-2 are generally wedge-shaped and gradually increase in height in a direction away from central region 125. A recessed slot or key-way 129 is provided along most of the length of front 107 so that, when ramp 101 is installed in the ground in the manner to be described below, asphalt, concrete or the like can be received in key-way 129 and allowed to harden therein, thereby more securely locking ramp 101 in place.

Rear 109 is generally rectangular in shape and has a constant height $h_4$, height $h_4$ being greater than height $h_3$ of front 107. A key-way 131 is provided along most of the length of rear 109, key-way 131 serving the same purpose as key-way 129.

Front left side 111 and rear left side 113, each of which has a level bottom edge and a sloped top edge, continuously taper in height from front 107 to rear 109. A key-way 133, which serves the same purpose as key-way 129, extends for most of the length of rear left side 113.

Front right side 115 and rear right side 117, which are mirror images of front left side 111 and rear left side 113, respectively, similarly taper in height from front 107 to rear 109. A key-way 135, which serves the same purpose as key-way 129, extends for most of the length of rear right side 117.

In view of the above, ramp 101 can be seen to include, in addition to curb portion 120, a central ramp region 141 and a pair of side ramp regions 143-1 and 143-2, side ramp regions 143-1 and 143-2 transitioning seamlessly from opposite sides of central ramp region 141. Central ramp region 141, whose top surface is generally trapezoidal in shape and extends from curb portion 120 to rear 109, slopes gradually upwardly from curb portion 120 to rear 109. Side ramp regions 143-1 and 143-2, whose top surfaces are generally triangular in shape and are positioned on opposite sides of central region 141 behind curb portion 120, slope gradually upwardly from central region 141 to sides 113 and 117, respectively.

The following exemplary dimensions for ramp 101 are illustrative only: front 107 has a length $\mathbf{1}_1$ of 11 feet 3 inches, with central region 125 having a length $\mathbf{1}_2$ of 3 feet and each of side regions 127-1 and 127-2 having a length $\mathbf{1}_3$ of 4 feet 1.5 inches; rear 109 has a length $\mathbf{1}_4$ of 6 feet; each of front left side 111 and front right side 115 has a length $\mathbf{1}_5$ of 6 inches; each of rear left side 113 and rear right side 117 has a length $\mathbf{1}_6$ of 4 feet 4.5 inches; central region 125 has a height $h_3$ of 6 inches; each of side regions 127-1 and 127-2 has a maximum height $h_4$ (located at its point of intersection with front left side 111 and front right side 115, respectively) of 10.75 inches; each of rear left side 113 and rear right side 117 has a minimum height $h_5$ (located at its point of intersection with rear 109) of 9 inches; and each of slots 121-1, 121-2, 123-1 and 123-2 has a width $z_1$ of 3.5 inches and a depth $d_1$ of 1.5 inches.

With the above dimensions, ramp 101 has longitudinal and transverse slopes that comply with existing governmental standards.

Figure 6:
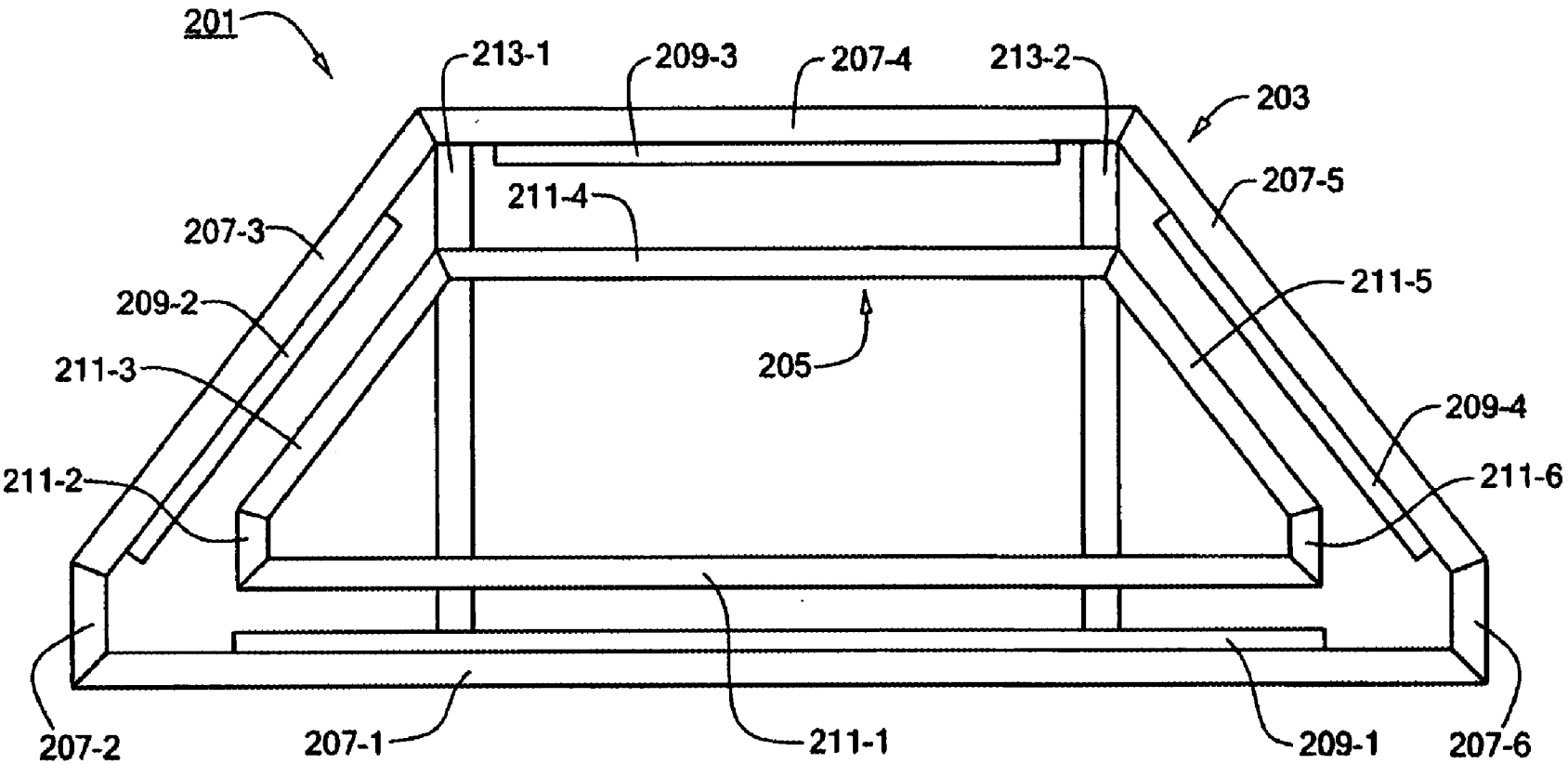
FIG. 6 is a top view of a forming apparatus adapted for use in forming the pre-cast curbside access ramp shown in FIGS. 5(*a*) through 5(*g*)

Referring now to FIG. 6, there is shown a top view of a forming apparatus adapted for use in forming ramp 101, said forming apparatus being represented generally by reference numeral 201.

Apparatus 201 comprises an outer form 203 and an inner form 205, inner form 205 being concentrically-disposed within outer form 203. Outer form 203, which has inside dimensions that correspond to the outside dimensions of ramp 101, comprises a plurality of wooden boards 207-1 through 207-6 that are appropriately arranged and detachably joined together by nails or other suitable means. (Alternatively, two or more of boards 207-1 through 207-6 may be hingedly interconnected to facilitate the removal of ramp 101 from form 203.) Form 203 also comprises a plurality of knockout boards 209-1 through 209-4 that are secured to boards 207-1, 207-3, 207-4 and 207-5 and that are used to form key-ways 129, 133, 131 and 135, respectively.

Inner form 205, which has outer dimensions that correspond to the dimensions of cavity 119, comprises a plurality of wooden boards 211-1 through 211-6 that are joined together by nails or other suitable means to have a shape similar to that of outer form 203, the principal difference between the two forms being that inner form 205 is more shallow and has a smaller overall size than outer form 203.

Apparatus 201 further includes a pair of wooden knockout boards 213-1 and 213-2, knockout boards 213-1 and 213-2 extending in a parallel fashion between boards 207-1 and 207-4 and being used to create slots 121-1, 121-2, 123-1 and 123-2 in ramp 101. Recesses (not shown) are provided on the bottom of board 211-1 and corresponding recesses (not shown) are provided on the bottom of board 211-4 to permit knockout boards 213-1 and 213-2, respectively, to pass thereunder.

Although apparatus 201 has been described above as being made primarily of wood, it can readily be appreciated that apparatus 201 could be formed from metal (e.g., steel) or other suitable materials.

Figure 7:
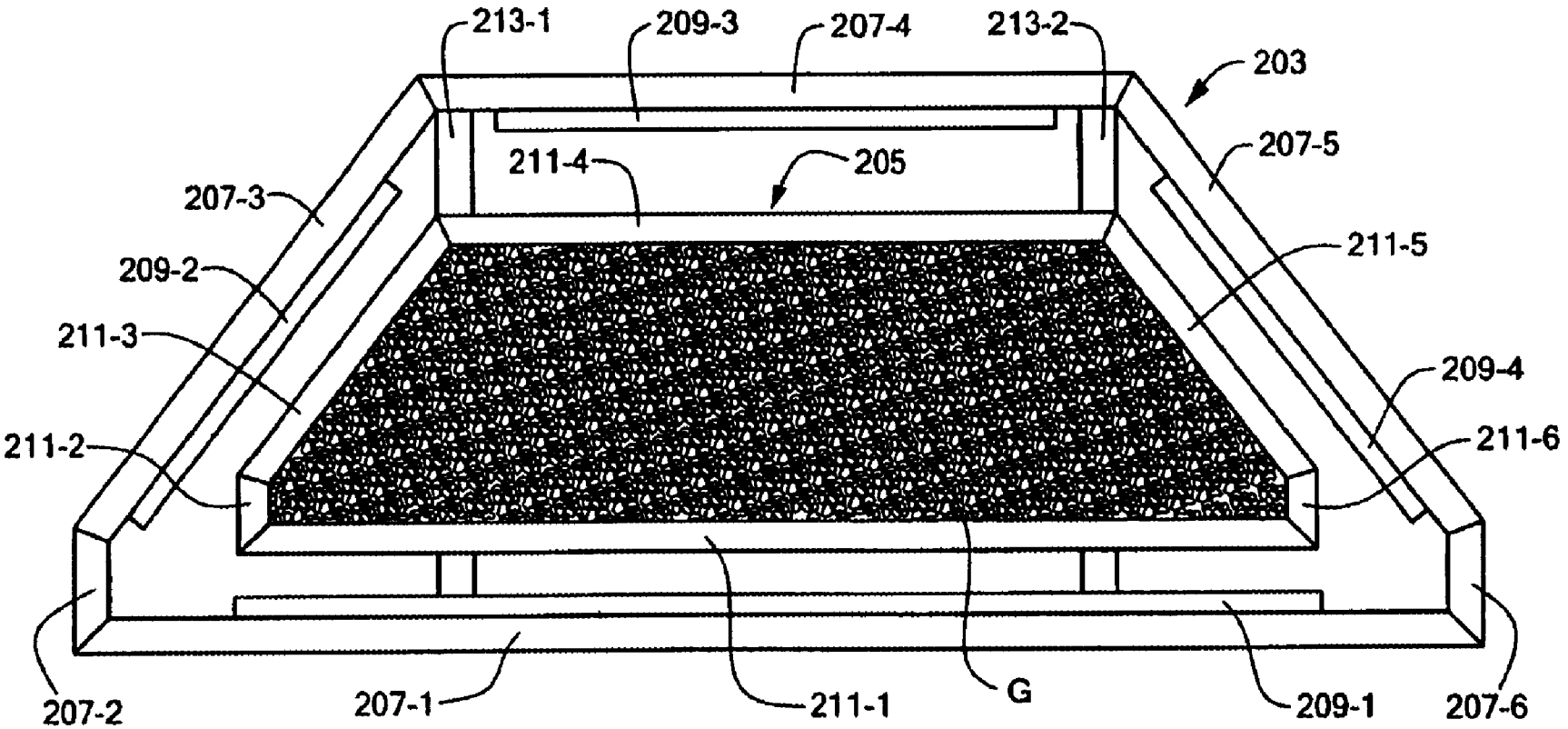
FIG. 7 is a top view of the forming apparatus of FIG. 6, with the inner form thereof shown filled with gravel.

To use apparatus 201 to form ramp 101, one first lays apparatus 201 horizontally on a level non-stick surface. (Although not required, the inside surfaces of form 203 and/or the outside surfaces of form 205 may be treated with a curing oil to prevent concrete from sticking thereto.) Next, as shown in FIG. 7, inner form 205 is filled with gravel G or the like. As will be seen, the gravel G disposed within form 205 does not make its way into ramp 101, but rather, is merely used to occupy space within form 205 so that concrete cannot be poured into form 205. The space in form 205 occupied by gravel G ultimately becomes cavity 119 and, in the present embodiment, results in an approximately 500 lbs. reduction in weight of ramp 101 from what would otherwise be about 3700–3900 lbs. to about 3200–3400 lbs. Such a weight reduction is highly advantageous since it permits ramp 101 to be moved by standard construction equipment, like backhoes, that have a maximum weight capacity of about 3500 lbs. As can readily be appreciated, another benefit of creating cavity 119 with gravel G is that one can realize an appreciable savings in the amount of concrete needed to make ramp 101 (said savings being about one-quarter yard of concrete in the present embodiment).

Figure 8:
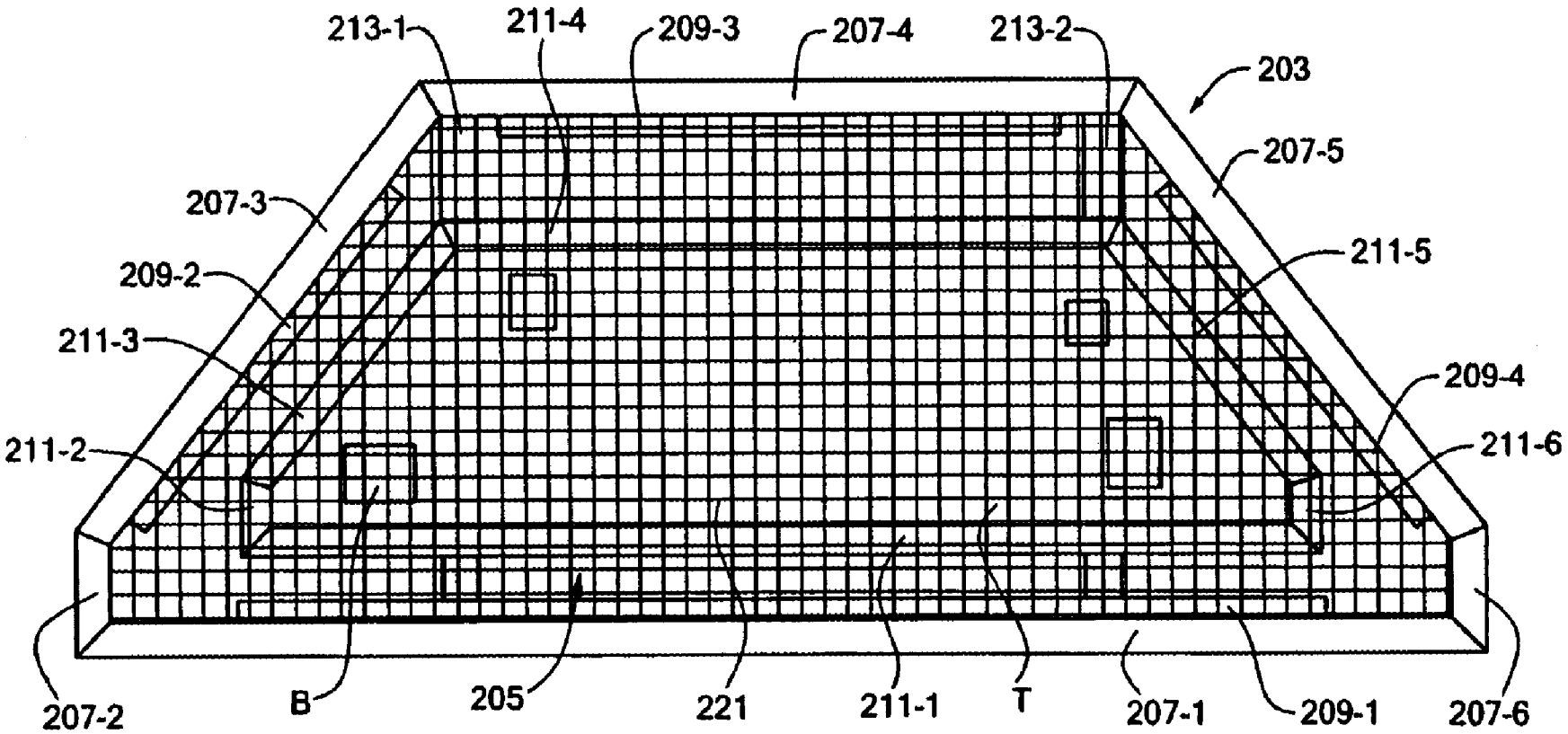
FIG. 8 is a top view of the forming apparatus of FIG. 7, with the inner form thereof shown further covered with a tarp and with a steel grid positioned over the tarp and within the outer form.

Next, as shown in FIG. 8, gravel G is covered with a tarp T, and a steel grid 221 is positioned within form 203 over tarp T. (One or more bricks B may be used to elevate grid 221 relative to tarp T.) Concrete is then poured into form 203, with grid 221 being enveloped within the poured concrete. The use of steel grid 221 in the present invention is advantageous because it serves to reinforce the concrete used to make ramp 101. Such reinforcement is desirable because, whereas concrete is strong in compression, it is weak in tension. Steel, on the other hand, is weak in compression but is strong in tension. Steel-reinforced concrete is not found in the conventional curbside access ramps described above. Moreover, because the pre-cast ramp of the present invention is intended to be transported, the reinforcement provided to the ramp by steel grid 221 helps to preserve the integrity of ramp 101 during transport.

The concrete poured into form 203 is preferably that typically used to make curbside access ramps, namely, 4000 pound peastone mix concrete. It should be understood, however, that additives to such concrete could be added, such additives including salt resistant chemicals to guard against corrosion caused by salts (particularly ice-melting salts used in colder climates), strength-enhancing materials like fiber-mesh (particularly if grid 221 were to be omitted), and chemicals like high-early to hasten hardening of the concrete.

Figure 9A:
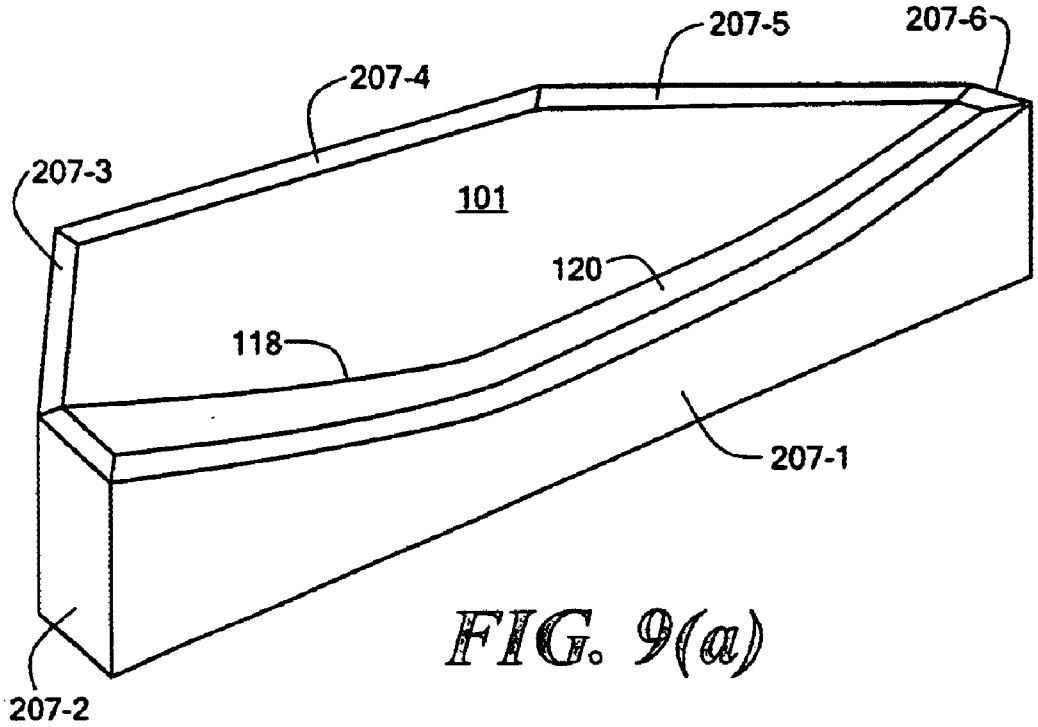
FIGS. 9(*a*) and 9(*b*) are perspective and top views, respectively, of the forming apparatus of FIG. 8, with concrete having been poured over the inner form and into the outer form and being allowed to harden.
Figure 9B:
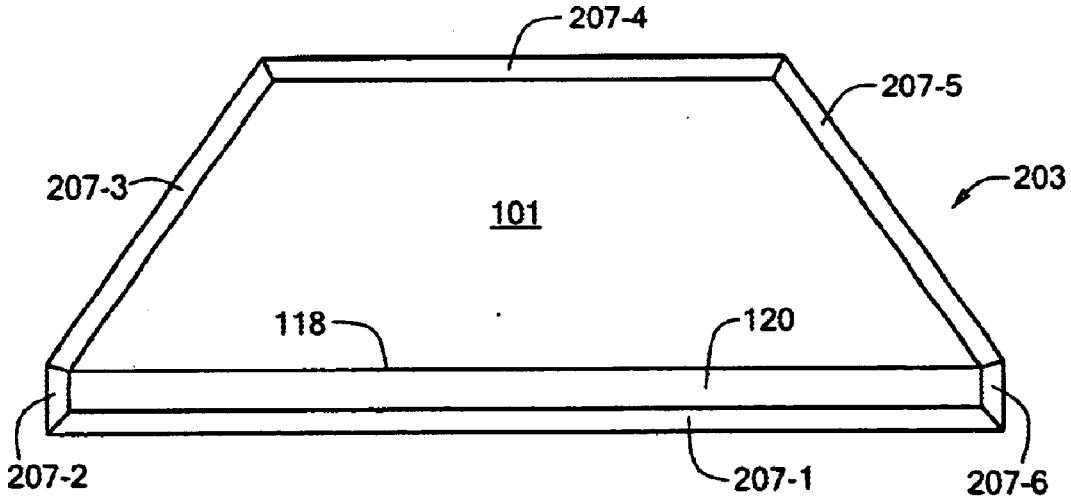

Next, the concrete within form 203 is shaped, screeded, edged, grooved, and troweled until it has been transformed into its finished state as ramp 101, as seen in FIGS. 9(*a*) and 9(*b*). (Ramp 101 may be textured with a broom finish, a brick-pattern finish or the like; alternatively, regions 141, 143-1 and 143-2 of ramp 101 may be decorated with brickface. Curb portion 120 is preferably colored and/or textured differently than regions 141, 143-1 and 143-2 to facilitate its detection by sight-impaired individuals and seeing-eye dogs.) Ramp 101 is then allowed to harden within form 203 for several days. Once ramp 101 has sufficiently hardened, ramp 101 and apparatus 201 are lifted off the ground, leaving gravel G to remain on the ground and revealing cavity 119. Inner form 205 and knockout boards 213-1 and 213-2 are then removed from ramp 101. Ramp 101 is then removed from outer form 203 and is ready to be transported to its ultimate destination.

As is apparent from the description above, the pre-cast curbside access ramp of the present invention is distinguishable from conventional curbside access ramps in that the pre-cast ramp is not formed in the hole in which it is to be used, but rather, is formed at a separate location and is then transported from its place of manufacture to its place of use. Consequently, the pre-cast ramp of the present invention is particularly well-suited for being manufactured in a factory setting. This permits uniformity in the size and shape of the ramps, as well as in the technique used to manufacture said ramps. It also permits certain processing equipment that would not be available at a construction site (such as a concrete vibrator) to be on-hand. It further permits the ramps to completely harden before they are delivered to an installation site.

Figure 10A:
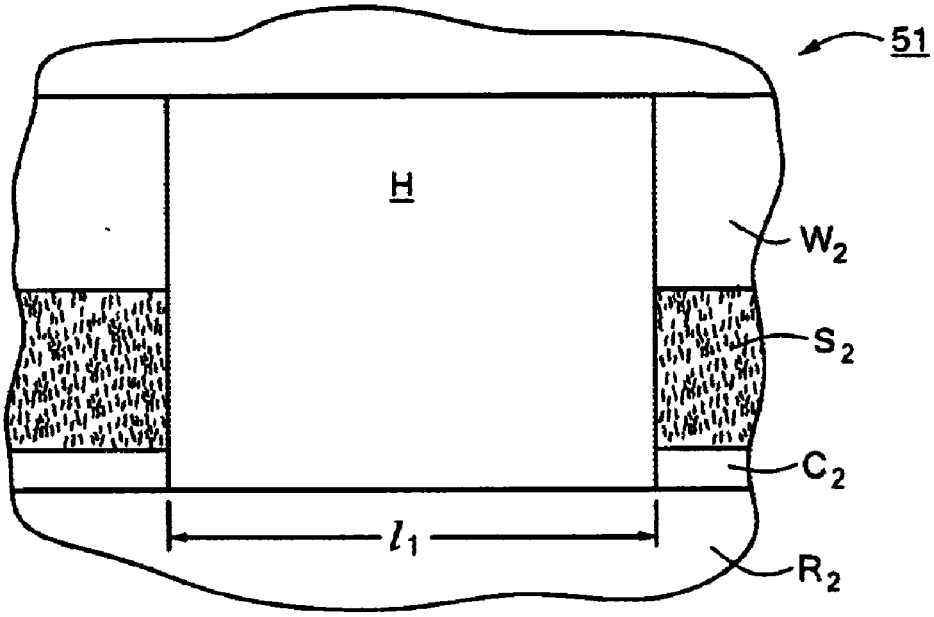
FIGS. 10(*a*) through 10(*c*) are top views illustrating the installation of the pre-cast curbside access ramp of FIGS. 5(*a*) through 5(*g*) in the area of FIG. 3.
Figure 10B:
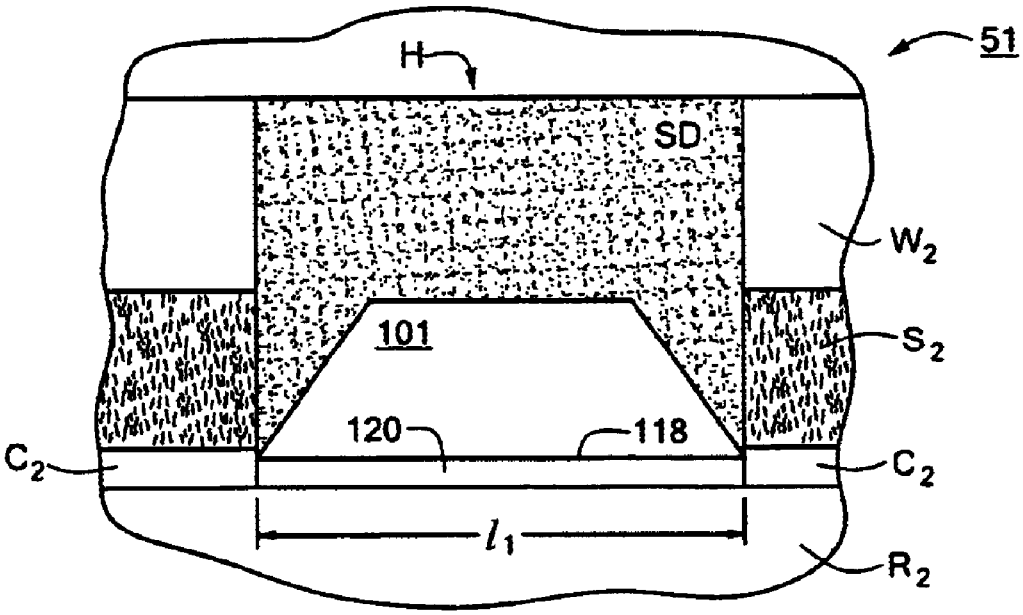
Figure 10C:
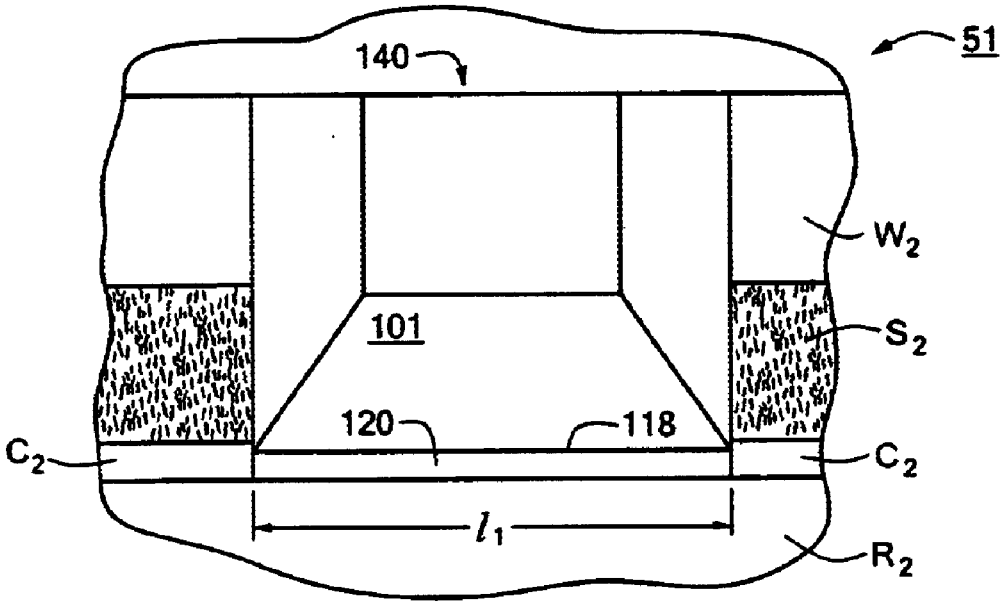

Referring now to FIGS. 10(*a*) through 10(*c*), there is shown the installation of ramp 101 in area 51, it being understood that area 51 has been selected for illustrative purposes only and that ramp 101 is also amenable for installation in area 21 and in many other areas in which it is desired to bridge a walkway and a roadway.

As seen in FIG. 10(*a*), area 51 is first prepped to receive ramp 101 by having a length of curb $C_2$ removed, said length corresponding to length $\mathbf{1}_1$ of front 107 of ramp 101. In addition, portions of strip $S_2$ and walkway $W_2$ (the lengths of said portions being determined in the manner to be described below) are also removed from area 51 to yield a hole H. Hole H is sufficiently deep for front region 125 of ramp 101 to lie flush with the rear edge of roadway $R_2$.

Next, as seen in FIG. 10(*b*), a layer of stone dust SD is applied to hole H, and ramp 101 is set in hole H. Typically, ramp 101 is lowered into hole H by feeding a pair of looped straps around ramp 101 and through slots 121-1, 121-2, 123-1 and 123-2 and then using the boom of a backhoe or the like to hold ramp 101 via said looped straps. Once ramp 101 is set in place, the straps are then un-looped and removed through slots 121-1, 121-2, 123-1 and 123-2.

Lastly, as seen in FIG. 10(*c*), the remainder of hole H is filled with concrete (or asphalt) and is finished to form a platform 140 that bridges ramp 101 and walkway $W_2$. As can readily be appreciated, one can ensure a gentle slope from ramp 101 to walkway $W_2$ by dimensioning and grading platform 140 as needed. In addition, if the differential in elevation between the rear of ramp 101 and walkway $W_2$ is sufficiently large, one can remove additional lengths of walkway $W_2$ and extend the slope of platform 140 gradually until walkway $W_2$ is reached. Good control points for grading platform 140 to walkway $W_2$ are provided by rear 109, rear left side 113 and rear right side 117 of ramp 101.

As can be seen, the present invention represents a departure in the manner in which ramps are constructed in that, according to the present invention, the ramp is set first and the walkway is then graded to the ramp whereas, in the past, the walkway is set first and the ramp is then graded to the walkway.

Figure 11:
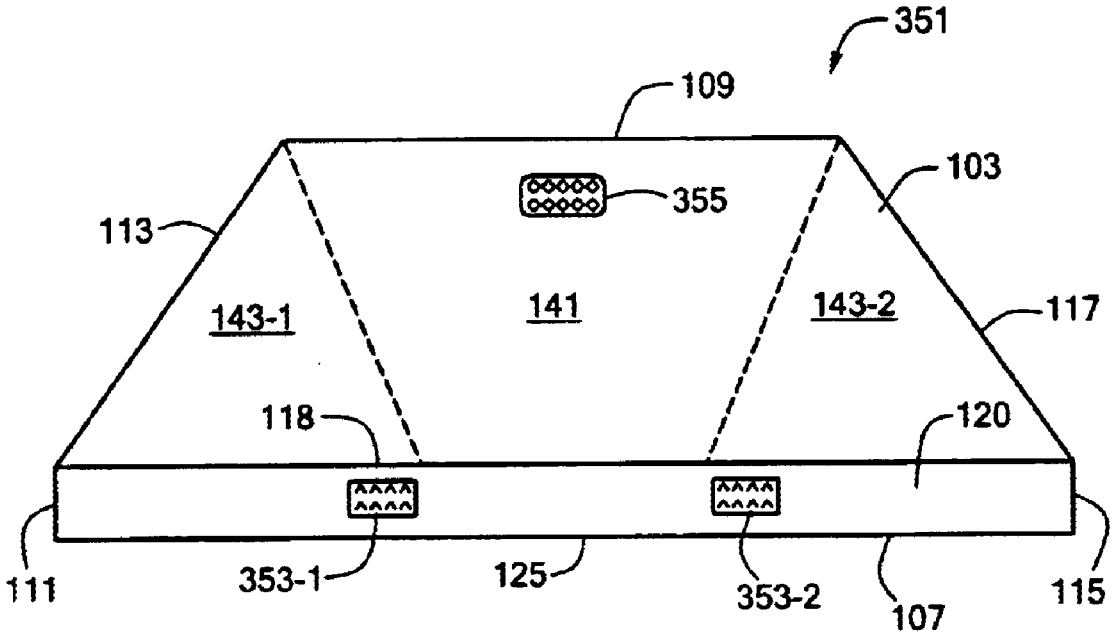
FIG. 11 is a top view of an embodiment of a pre-cast curbside access ramp assembly constructed according to the teachings of the present invention.

Referring now to FIG. 11, there is shown a top view of a pre-cast curbside access ramp assembly constructed according to the teachings of the present invention, said pre-cast curbside access ramp assembly being represented generally by reference numeral 351.

Ramp assembly 351 is similar in most respects to ramp 101, a principal difference between ramp assembly 351 and ramp 101 being that ramp assembly 351 additionally comprises a pair of brightly-colored and textured markers 353-1 and 353-2 affixed by a heat-melt adhesive to curb in portion 120 on opposite ends of central portion 125. Markers 353-1 and 353-2 serve to indicate to pedestrians, particularly those who are sight-impaired, the location of central region 141 of ramp 101.

Another difference between ramp assembly 351 and ramp 101 is that ramp assembly 351 in further comprises a recessed plate 355 secured to top 103 and located within central region 141 proximate to rear 109. Plate 355 is preferably received within a recess formed in ramp 101 by a knockout during the setting of ramp 101. Plate 355 may be an aluminum diamond plate or may be a bronze medallion embossed with advertising or the name of a sponsor. In either event, plate 355 further serves to indicate to pedestrians, both by appearance and texture (the embossments of plate 355 extending above the surface of top 103), the location of central region 141 of ramp 101.

As can readily be appreciated from the above description, markers 353-1 and 353-2 and plate 355 are arranged on ramp 101 in a triangular pattern. This triangular pattern, together with the textured surfaces of markers 353-1 and 353-2 and of plate 355, is intended to help the sight-impaired situate themselves on ramp 101.

Figure 12A:
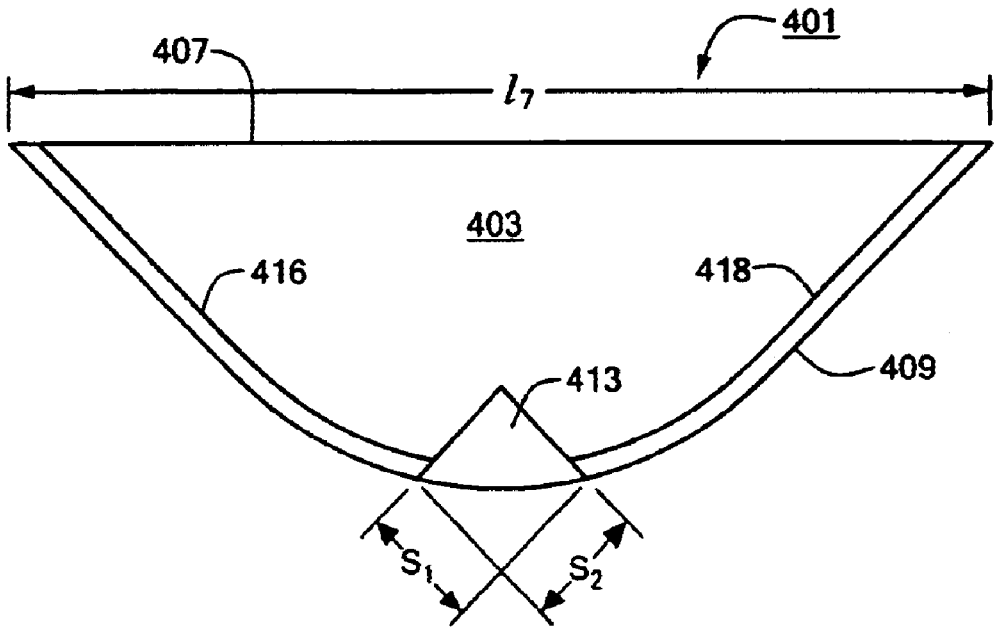
FIGS. 12(*a*) through 12(*c*) are top, right side and rear views, respectively, of an alternative embodiment of a pre-cast curbside access ramp constructed according to the teachings of the present invention.
Figure 12B:
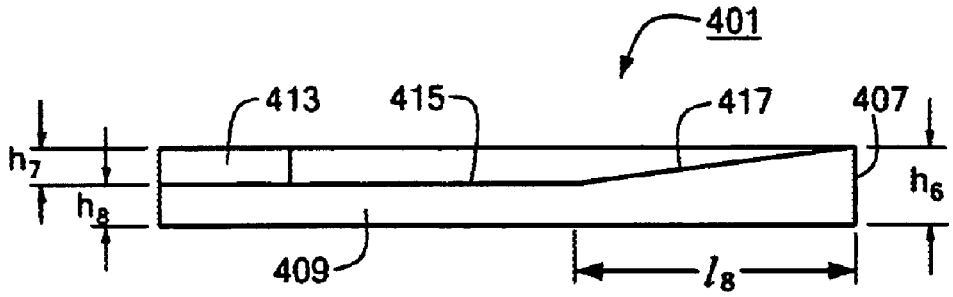
Figure 12C:
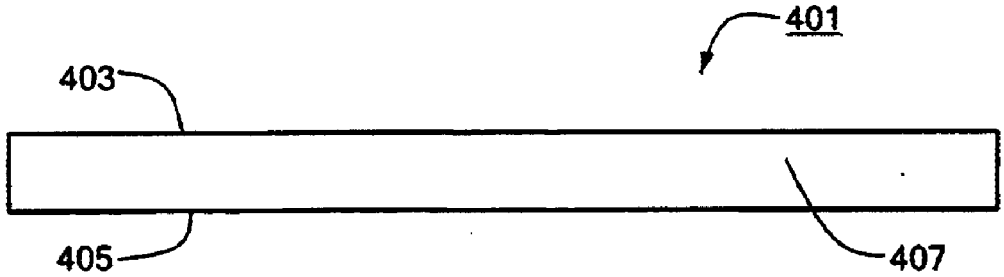

It is to be understood that the present invention is not limited to pre-cast curbside access ramps of any particular size and/or shape. For example, another embodiment of a pre-cast curbside access ramp constructed according to the teachings of the present invention is shown in FIGS. 12(*a*) through 12(*c*), said pre-cast curbside access ramp being represented generally by reference numeral 401.

Ramp 401, which is particularly well-suited use at the apices of an intersection where it is desirable to bridge the roadway with a pair of perpendicular walkways, is a quasi-triangular member shaped to include a top 403, a bottom 405, a straight side 407, and an arcuate side 409, one end of arcuate side 409 being joined to one end of straight side 407, the other end of arcuate side 409 being joined to the opposite end of straight side 407.

Top 403 is shaped to include a triangularly shaped post 413 located along the midpoint of arcuate side 409. Top 403 is also shaped to include a flat area 415 surrounding post and a sloped area 417 extending from flat area 415 to straight side 407. A groove 416 is formed in top 403 to delineate an integrally formed curb portion 418.

The following exemplary dimensions for ramp 401 are illustrative only: straight side 407 has a length $l_7$ of 11 feet 6 inches and a height $h_6$ of 9.5 inches; post 413 has a height $h_7$ of 3.5 inches and side lengths $s_1$ and $s_2$ of 18 inches; arcuate side 409 has a height $h_8$ of 6 inches; and sloped area has a length $l_8$ of 2 feet 5 inches.

The embodiments of the present invention recited herein are intended to be merely exemplary and those skilled in the art will be able to make numerous variations and modifications to it without departing from the spirit of the present invention. All such variations and modifications are intended to be within the scope of the present invention as defined by the claims appended hereto.

What is claimed is:

1. A pre-cast curbside access ramp assembly, said pre-cast curbside access ramp assembly comprising:

(a) a pre-cast curbside access ramp, said pre-cast curbside access ramp having a top, a bottom, a front, a rear, a front left side, a rear left side, a front right side and a rear right side and being shaped to include an integrally formed curb portion, said integrally formed curb portion extending from said front left side to said front right side and including a central region adapted to lie flush with a roadway and side regions disposed on opposite ends of said central region adapted to slope gradually upwardly from said central region and wherein said pre-cast curbside access ramp is further shaped to include a central ramp region and a pair of side ramp regions, said central ramp region and said side ramp regions being disposed behind said integrally formed curb portion, said side ramp regions being disposed on opposite sides of said central ramp region and transitioning seamlessly therefrom, said central ramp region sloping from said integrally formed curb portion to said rear with a maximum slope of no greater than 1:12, said side ramp regions sloping from said central ramp region to said rear left side and said rear right side, respectively, with a maximum slope of no greater than 1:10; and (b) a pair of markers mounted on opposite ends of said central region of said integrally formed curb portion for indicating the location of said central region of said integrally formed curb portion, wherein said markers are brightly-colored, textured markers affixed to said integrally formed curb portion by a hot-melt adhesive.

2. The pre-cast curbside access ramp assembly as claimed in claim 1 further comprising a textured, recessed plate secured to the top of said pre-cast curbside access ramp and centrally located within the central ramp region of said pre-cast curbside access ramp proximate to said rear.

3. The pre-cast curbside access ramp assembly as claimed in claim 2 wherein said textured, recessed plate is an aluminum diamond plate.

4. The pre-cast curbside access ramp assembly as claimed in claim 2 wherein said textured, recessed plate is a bronze medallion embossed with advertising.

5. A pre-cast curbside access ramp assembly, said pre-cast curbside access ramp assembly comprising:

(a) a pre-cast curbside access ramp, said pre-cast curbside access ramp having a top, a bottom, a front, a rear, a front left side, a rear left side, a front right side and a rear right side and being shaped to include an integrally formed curb portion, said integrally formed curb portion extending from said front left side to said front right side and including a central region adapted to lie flush with a roadway and side regions disposed on opposite ends of said central region adapted to slope gradually upwardly from said central region and wherein said pre-cast curbside access ramp is further shaped to include a central ramp region and a pair of side ramp regions, said central ramp region and said side ramp regions being disposed behind said integrally formed curb portion, said side ramp regions being disposed on opposite sides of said central ramp region and transitioning seamlessly therefrom, said central ramp region sloping from said integrally formed curb portion to said rear with a maximum slope of no greater than 1:12, said side ramp regions sloping from said central ramp region to said rear left side and said rear right side, respectively, with a maximum slope of no greater than 1:10; and (b) a textured, recessed plate secured to the top of said pre-cast curbside access ramp and centrally located within the central ramp region of said pre-cast curbside access ramp proximate to said rear.

6. A curbside access ramp assembly bridging a roadway and a walkway, said curbside access ramp assembly comprising:

(a) a curbside access ramp, said curbside access ramp comprising a curb and a sloped embankment, said curb having a middle portion set flush with the roadway; and (b) means affixed to said curbside access ramp for identifying the location of said middle portion of said curb, said identifying means comprising a pair of brightly-colored, textured markers mounted on opposite ends of said middle portion of said curb and a textured, recessed plate secured to said sloped embankment at a point centrally located between said brightly-colored textured markers.

* * * * *